US012435503B2

(12) United States Patent
Tarak

(10) Patent No.: US 12,435,503 B2
(45) Date of Patent: Oct. 7, 2025

(54) FREE-STANDING DECK FRAMING OF MODULAR DESIGN, INCLUDING OVERHEAD STRUCTURES

(71) Applicant: Farzan Tarak, Sinking Spring, PA (US)

(72) Inventor: Farzan Tarak, Sinking Spring, PA (US)

( * ) Notice: Subject to any disclaimer, the term of this patent is extended or adjusted under 35 U.S.C. 154(b) by 200 days.

(21) Appl. No.: 18/128,723

(22) Filed: Mar. 30, 2023

(65) Prior Publication Data

US 2023/0313519 A1 Oct. 5, 2023

Related U.S. Application Data

(60) Provisional application No. 63/327,577, filed on Apr. 5, 2022.

(51) Int. Cl.
*E04B 1/00* (2006.01)
*E04F 15/02* (2006.01)

(52) U.S. Cl.
CPC ..... *E04B 1/003* (2013.01); *E04F 15/02183* (2013.01)

(58) Field of Classification Search
CPC ..... E04B 1/003; E04B 2001/2406; E04B 2001/2415; E04B 2001/2418; E04B 1/341; E04B 2001/3235; E04B 2001/3241; E04B 2001/3247; E04B 2001/3252; E04F 10/005; E04F 10/08; E04F 15/02183
See application file for complete search history.

(56) References Cited

U.S. PATENT DOCUMENTS

| | | | | |
|---|---|---|---|---|
| 5,553,439 | A | 9/1996 | Grossman | |
| 5,634,308 | A | 6/1997 | Doolan | |
| 6,427,403 | B1 * | 8/2002 | Tambakis | E04B 1/28 52/309.1 |
| 6,691,478 | B2 | 2/2004 | Daudet et al. | |
| 8,234,827 | B1 | 8/2012 | Schroeder, Sr. et al. | |
| 8,640,420 | B1 * | 2/2014 | Halley | E04F 10/08 52/650.1 |
| 8,863,466 | B1 * | 10/2014 | Winter | E04B 5/023 52/634 |
| 8,959,844 | B2 | 2/2015 | Ingalls | |
| 8,959,849 | B1 * | 2/2015 | DiGirolamo | E04B 1/003 52/715 |

(Continued)

FOREIGN PATENT DOCUMENTS

| | | | | |
|---|---|---|---|---|
| EP | 2186956 | A1 * | 5/2010 | E04B 1/2403 |
| FR | 3093119 | A1 * | 8/2020 | E04B 1/24 |

(Continued)

*Primary Examiner* — Theodore V Adamos
(74) *Attorney, Agent, or Firm* — Wendy W Koba

(57) ABSTRACT

A modular, free-standing deck framing system is disclosed that eliminates the need for a ledger board attachment to a building (house), yet retains the stability required for home construction standards. If desired, the sheet metal framing system may be attached to an existing building using metal ledger beams in combination with conventional metal brackets and fasteners. Various embodiments of the inventive framing system further include the capability to supplement the deck with a sheet metal pergola structure, including the capability of orienting the pergola slats (also referred to in some instances as "louvers") for optimum shading capabilities.

13 Claims, 9 Drawing Sheets

(56) References Cited

U.S. PATENT DOCUMENTS

| | | | | |
|---|---|---|---|---|
| 9,057,190 | B1 * | 6/2015 | Winter | E04F 15/04 |
| 9,932,734 | B1 | 4/2018 | Winter | |
| 10,100,516 | B2 | 10/2018 | Burt et al. | |
| 10,550,570 | B2 | 2/2020 | Burt et al. | |
| 10,851,544 | B1 * | 12/2020 | Volin | E04F 10/10 |
| 11,028,580 | B2 | 6/2021 | Burt et al. | |
| 2005/0252161 | A1 * | 11/2005 | Hovey, Jr. | E04B 1/24 52/837 |
| 2006/0230697 | A1 | 10/2006 | Lupton | |
| 2007/0227080 | A1 * | 10/2007 | Tseng | E04F 10/08 52/78 |
| 2010/0031587 | A1 * | 2/2010 | Weeks | E04C 3/07 52/126.6 |
| 2012/0291378 | A1 | 11/2012 | Schroeder, Sr. et al. | |
| 2013/0031851 | A1 * | 2/2013 | Verdecia | E04H 1/1205 52/126.1 |
| 2013/0180190 | A1 * | 7/2013 | Bovet | E04B 1/19 52/298 |
| 2014/0290154 | A1 * | 10/2014 | Perko | E04H 9/145 52/126.5 |
| 2018/0094432 | A1 * | 4/2018 | Burt | E04C 3/07 |
| 2020/0115908 | A1 * | 4/2020 | Lavery | E04H 1/1205 |
| 2020/0181918 | A1 * | 6/2020 | Auer | E04B 1/34321 |

FOREIGN PATENT DOCUMENTS

| | | | | |
|---|---|---|---|---|
| WO | WO-2020183507 | A1 * | 9/2020 | E04B 1/003 |
| WO | WO-2021163804 | A1 * | 8/2021 | B66C 1/10 |

* cited by examiner

FREE-STANDING DECK FRAMING OF MODULAR DESIGN, INCLUDING OVERHEAD STRUCTURES

CROSS-REFERENCE TO RELATED APPLICATIONS

This application claims the benefit of U.S. Provisional Application No. 63/327,577, filed Apr. 5, 2022 and incorporated herein by reference.

TECHNICAL FIELD

The present invention relates to framing systems and, more particularly, for free-standing framing system for a deck that is structurally independent from the house or other building with which it is located.

BACKGROUND OF THE INVENTION

Residential deck structures are often formed as an integral component of the home, using the combination of a ledger board secured to an exterior surface of the home and a spaced-apart beam as the anchoring arrangement for the deck frame. The framing structure includes columns and joists to join together the ledger board and the beam, with deck boards then placed on the joists to provide a deck surface. Railing systems may also be provided around the perimeter of the deck.

One problem with this type of deck construction is the need for a ledger board attached to the home. There is known to be a large number of "deck failures" that can be attributed to deterioration in and around a deck ledger board (primarily as a result of moisture intrusion). This type of deck construction may also obstruct the use of space beneath the deck, and may not be appealing to homeowners or architects looking to increase the attractiveness of outdoor living areas.

Another problem with conventional wood-based deck framing, particularly with elevated deck structures, is their low level of wind resistance. As a result, during various high-wind events (e.g., thunderstorms, blizzards, or the like) various pieces of the deck structure may become loose and cause damage to surrounding structures unless the structure has been engineered to be wind-resistant. Building these conventional decks to sustain high winds without damage can result in a significant (and obviously unwanted) increase in cost.

SUMMARY OF THE INVENTION

The present invention addresses the various problems remaining in the prior art framing systems and, more particularly, discloses a free-standing framing system for a deck that is structurally independent from the house or other building with which it is located.

In accordance with the principles of the present invention, a modular, free-standing deck framing system is disclosed that eliminates the need for a ledger board attachment to a building (house), yet retains the stability required for home construction standards. If desired, the sheet metal framing system may be attached to an existing building using metal ledger beams in combination with conventional metal brackets and fasteners. Various embodiments of the inventive framing system further include the capability to supplement the deck with a sheet metal pergola structure, including the capability of orienting the pergola slats (also referred to in some instances as "louvers") for optimum shading capabilities.

The deck framing may further include a covering structure, such as a pergola or a more rounded, dome-like structure. The covering structure may be formed to include angled slats/louvers to allow for sunlight to pass through. The angled slats may be fixed in position, or capable of rotation; in some embodiments selected sets of slats may be fixed with other sets capable of rotation.

An exemplary embodiment of the present invention may take the form of a free-standing modular decking system for use with an existing structure, where the free-standing decking system comprises a plurality of sheet metal support posts used in combination with a plurality of sheet metal support beams configured in any modular design that is desired by the homeowner. That is, the plurality of sheet metal support posts is disposed in a pattern considered to support a designed floor load, including at least a front set of spaced-apart support posts and a rear set of spaced-apart support posts in alignment with the front set (the plurality of sheet metal support posts for being permanently affixed to ground locations). The number of individual support posts and locations thereof providing a modular design of any desired arrangement with the possibility of including further attachments thereto at a later point in time. The plurality of sheet metal support beams is arranged between adjacent ones of the front set of spaced-apart support posts and also between adjacent ones of the rear set of spaced-apart support posts, with bracket-based attachment members used to affix the plurality of sheet metal support beams to the plurality of sheet metal support posts, Again, the number and location of the sheet metal support beams may also be reconfigured over time to support the modular design of the free-standing decking system.

Other and further disclosures and embodiments of the present invention will become apparent during the course of the following discussion and by reference to the related drawings.

BRIEF DESCRIPTION OF THE DRAWINGS

Referring now to the drawings, where like numerals represent like parts in several views.

DETAILED DESCRIPTION

Figures 1, 2:
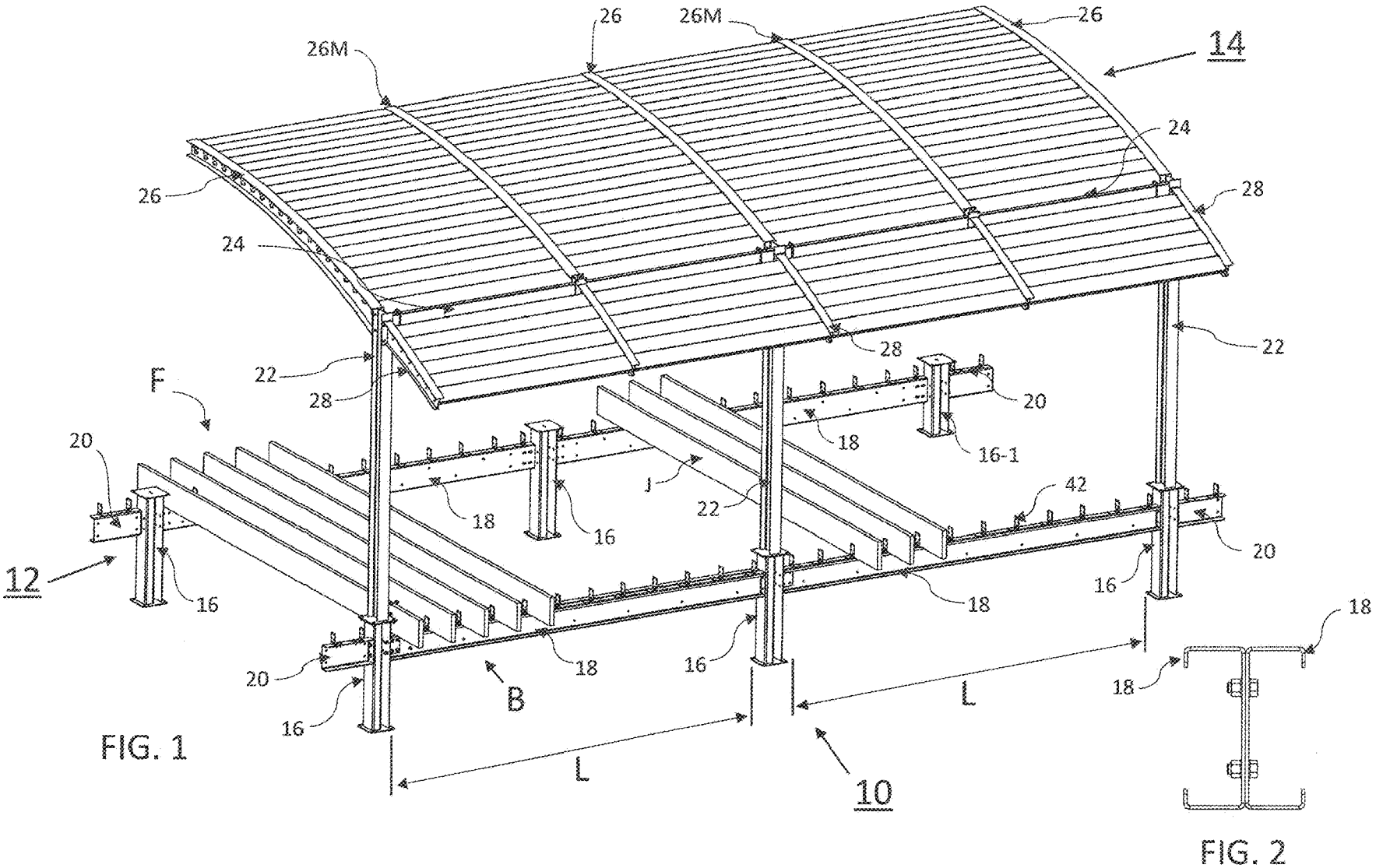
FIG. 1 illustrates an exemplary free-standing deck framing system formed in accordance with the principles of the present invention.
FIG. 2 is a cut-away view showing a pair of C-shaped channel beam that may be attached back-to-back to form a main beam of the deck framing system.

FIG. 1 illustrates an exemplary free-standing deck framing system 10 formed in accordance with the principles of the present invention. The sheet metal forms used in framing system 10 comes in different sizes to be used for decking beams and ledgers, and comes in the same design for mounting joists to the flange side of the beam. The joists may be metal or wood, and can be mounted on the top flange side of the C-shape channel beams (preferably using L-shaped metal brackets and fasteners for attachment). The C-shaped channel beams may be disposed in a back-to-back arrangement to create an I-beam configuration, which may be preferred for carrying higher loads.

With particular reference to FIG. 1, deck framing system 10 is shown in this embodiment as comprising a free-standing base framing system 12 and an accompanying pergola framing system 14. It is to be understood that the pergola portion of the framing system is optional, and may be added to an initially-formed deck framing system 10 at any appropriate time thereafter.

Base framing system 12 is shown as comprising a plurality of spaced apart sheet metal support posts 16, with the form of the support posts most clearly depicted in the illustration of support post 16-1. A plurality of main sheet metal beams 18 is attached between support posts 16 in the manner shown in FIG. 1, with a set of shorter, sheet metal cantilever beams 20 attached to outer surfaces of support posts 16. As mentioned above, main beams 18 may comprise C-shaped beams disposed singly between adjacent posts 16, or pairs of C-shaped channel beams may be joined in a back-to-back configuration, as shown in FIG. 2, to form an I-beam structure that may be used as a main beam. An advantage of the modularity of the inventive deck framing system is that both options are available (i.e., either single C-shaped beams, or back-to-back C-beams) and easy to work with, including making changes on site.

It is to be understood that an additional width (and/or length) of the arrangement of FIG. 1 may easily be formed by adding additional support posts. The configuration as shown is contemplated as just one example for illustrating the individual components of the framing system. Several joists J as shown as attached between the front row F and back row B of main beams 18. A preferred arrangement for fastening joists J will be discussed below, and as mentioned above it is contemplated that either wood or metal joists may be used.

Pergola framing system 14 is shown in FIG. 1 as comprising a set of vertical posts 22 that are attached to the top surfaces of the back row (B) of support posts 16. Horizontal beams 24 are attached between adjacent vertical posts 22 (better illustrated in FIG. 3). A plurality of long curved beams 26 extend forward from the upper terminations of vertical posts 22; additional long curved beams 26M, located at the midpoints between posts 16, may also extend forward from horizontal beams 24 to provide additional structural support for pergola framing system 14. A plurality of short curved beams 28 extend reward and are matched with long curved beams 26 in a one-to-one relationship.

Figure 3:
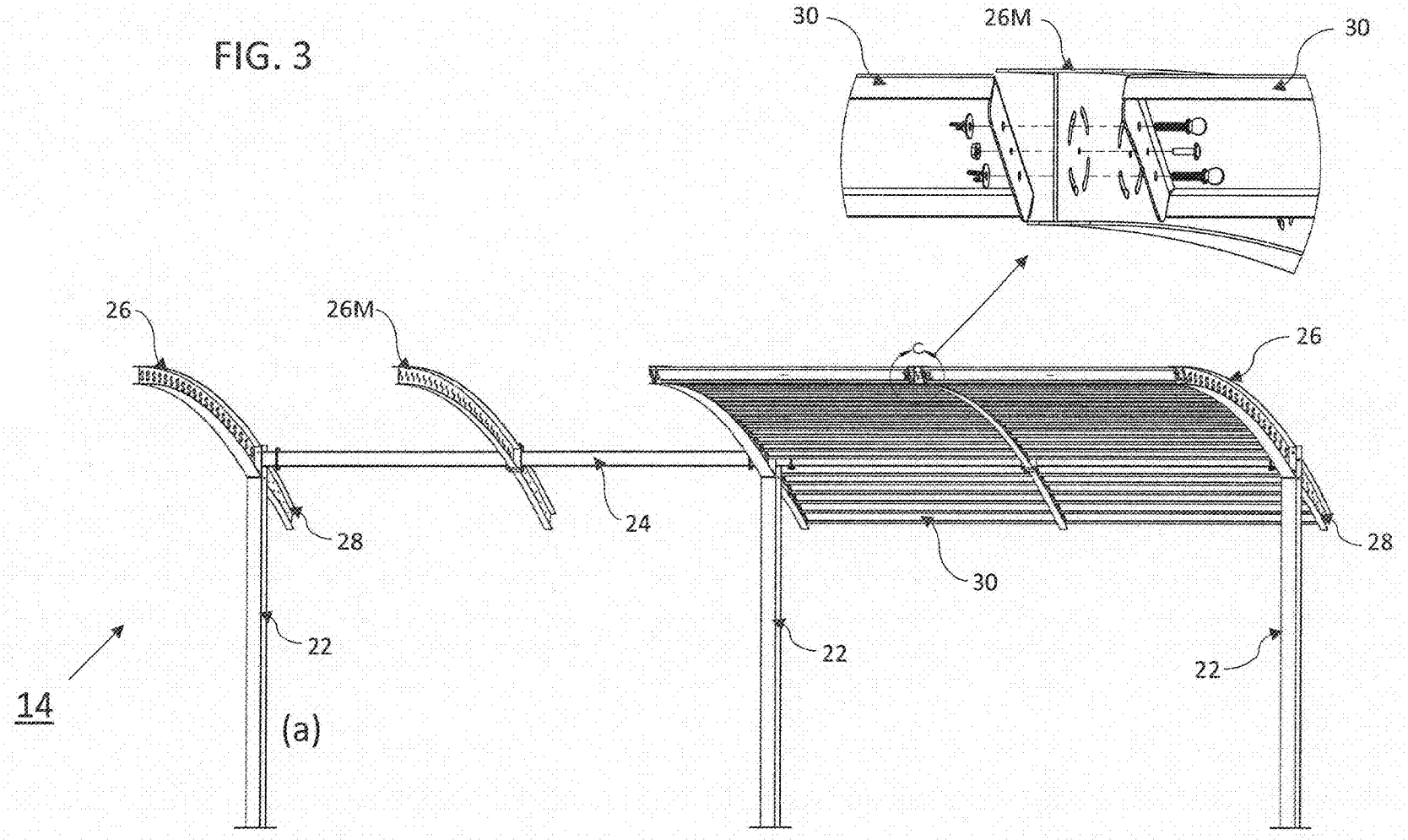
FIG. 3 illustrates an exemplary pergola framing system that may be used in conjunction with the inventive deck framing system.
Figure 4:
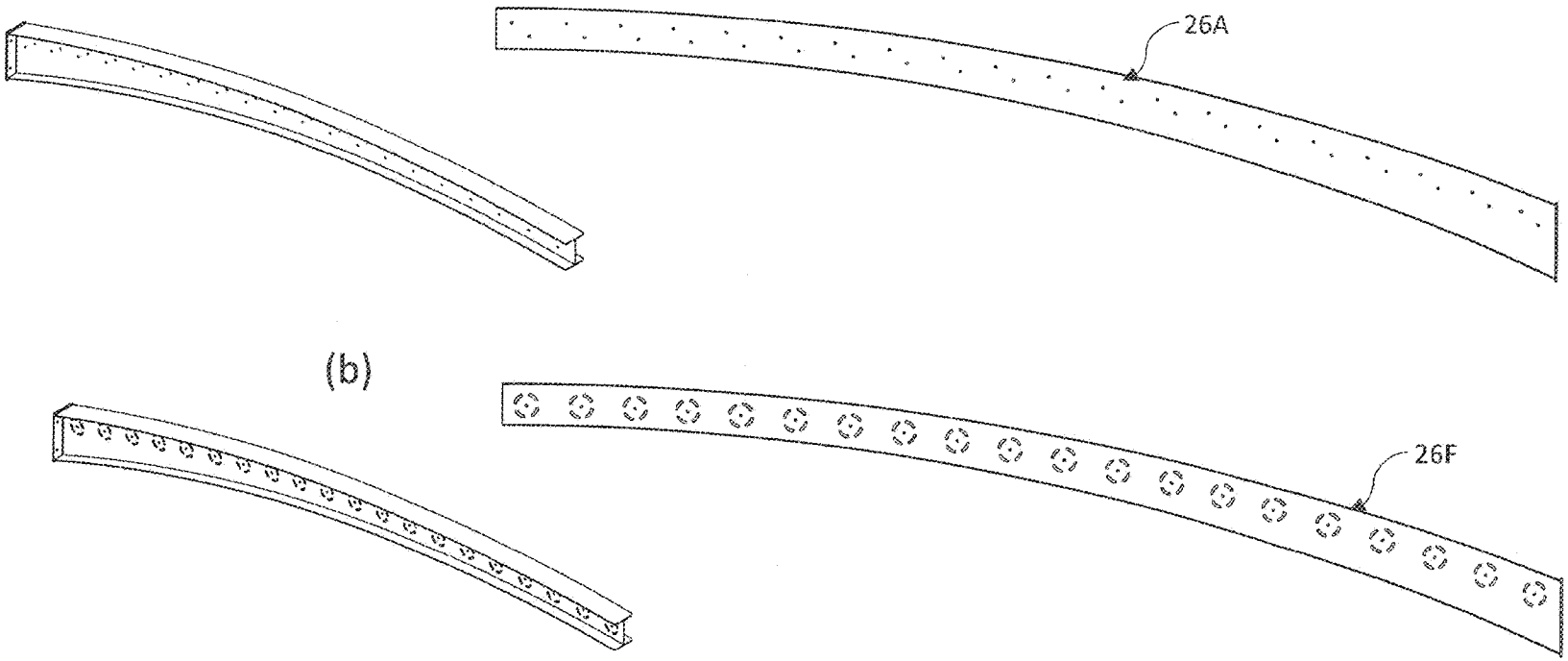
FIG. 4 contains side view illustrations of two different types of covering support beams, as used in the pergola configuration of FIG. 3, with a first side view in diagram (a) illustrating a structure for holding slats in an adjustable position and a second side view in diagram (b) illustrating a structure for holding slats in a fixed position.

A plurality of slats (louvers) 30 are shown as fit into features formed within curved beams 26, 28, with two exemplary types of beams 26 shown in FIG. 4. An enlargement included with FIG. 3 illustrates a particular configuration for attaching a long curved beam 26M between opposing end terminations of adjacent slats 30. The use of the term "slats" hereafter is considered to encompass all such configurations that may also be referred to in some contexts as "louvers", "blinds", or the like.

The use of modular components in accordance with the principles of the present invention allows for beams 26 to be formed in a manner that holds slats 30 in a position where the angle (pitch) of the slats with respect to the pergola framing may be adjustable, thus controlling the amount of shade that may be offered at any given time. FIG. 4(*a*) is a side view of an exemplary beam 26A formed to include fixturing that allows for the position of the slats to be adjusted. Of course, it is also possible to hold slats 30 in a fixed position, and FIG. 4(*b*) is a side view of an exemplary side beam 26F including attachment means for holding slats 30 in a stationary form.

Figure 5:
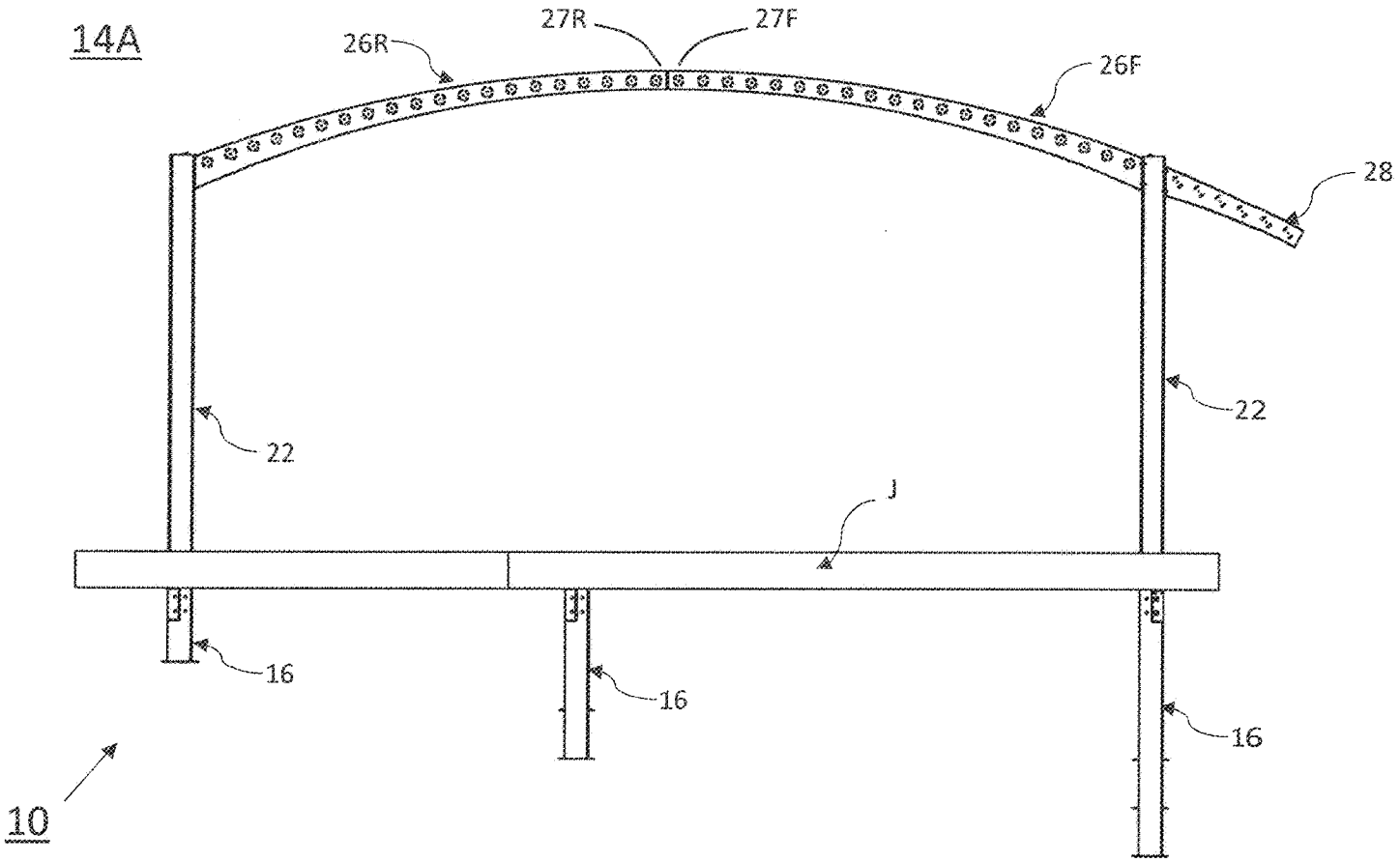
FIG. 5 illustrates a different type of covering structure, in this case a dome-like structure, that may be used in conjunction with the inventive deck framing system.

In selected embodiments, the plurality of long curved beams 26 may be formed to extend to the exterior surface of the adjacent house (or similar structure). Thus, at times such a configuration may be referred to as an "awning" instead of a pergola. Yet another type of covering structure is shown in a side-view configuration of FIG. 5. Referred to as a "dome" cover 50, the configuration of covering structure 14A is shown as using paired configurations of long curved beams 26 (depicted as 26-F (front) and 26-R (rear)) that are positioned such that their high end terminations 27-F, 27-R are joined together at a midpoint area of the created "dome". In this particular arrangement, a short beam 28 is attached to a lower termination of front beam 26-F. Although not visible in this side view of FIG. 5, a plurality of paired sets of beams 26-F, 26-R may extend along the length of an associated decking system (similar to the extension of pergola 14 along the length L of base framing system 12 as shown in FIG. 1.

Figure 6:
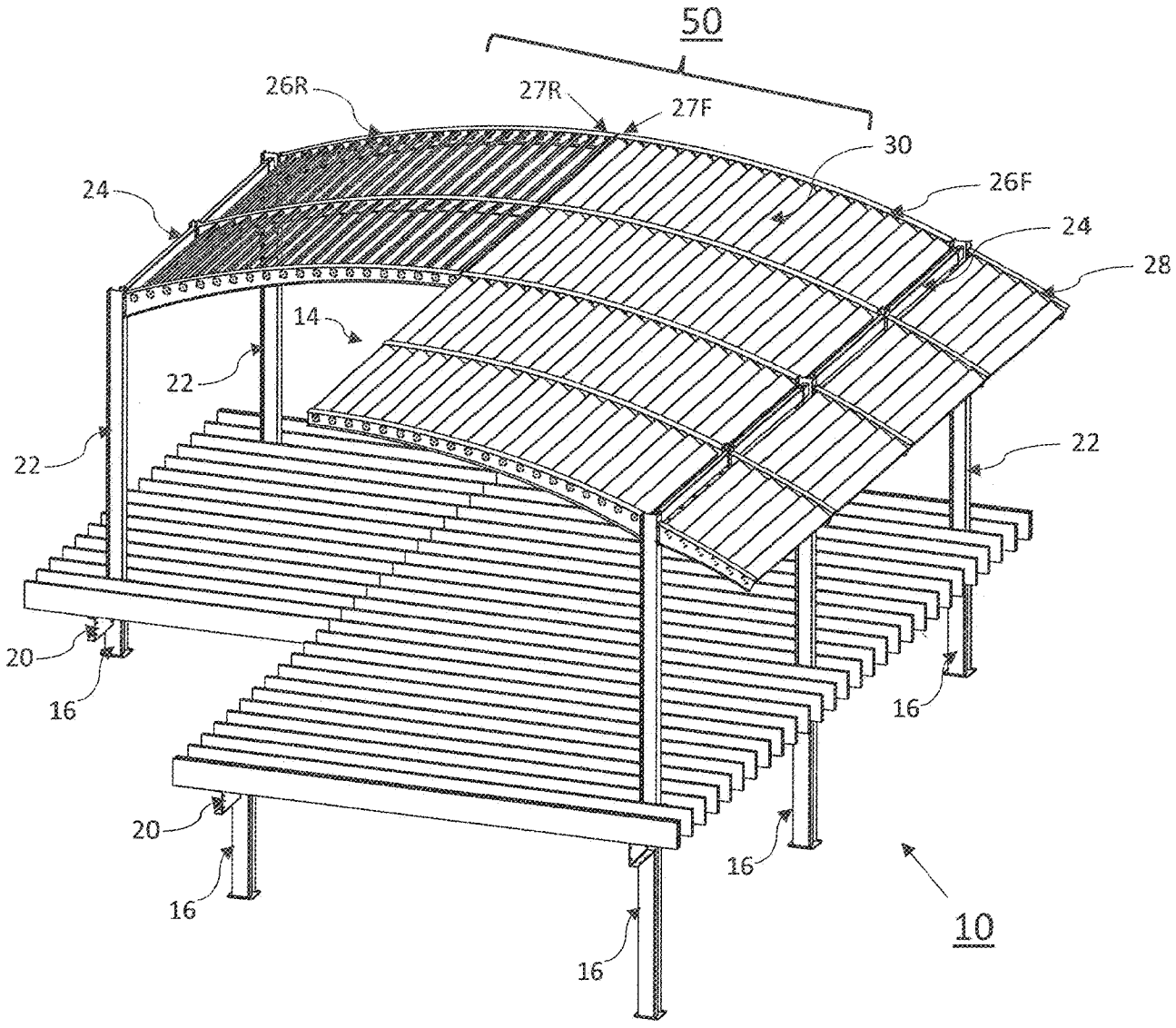
FIG. 6 is an isometric view of an exemplary deck framing system, particularly illustrating the modularity of the design, where in this case the deck framing system incorporates both a pergola covering structure and a dome covering structure.

Advantageously, in accordance with the modular nature of the construction components used to form the decking system of the present invention, it is also possible to extend a dome (or pergola, or combination of the two) along only a portion of the decking system, leaving other areas open without a covering. FIG. 6 illustrates one such modular arrangement of the present invention that is formed to include both a pergola covering structure 14 and a dome covering structure 50.

Figure 7:
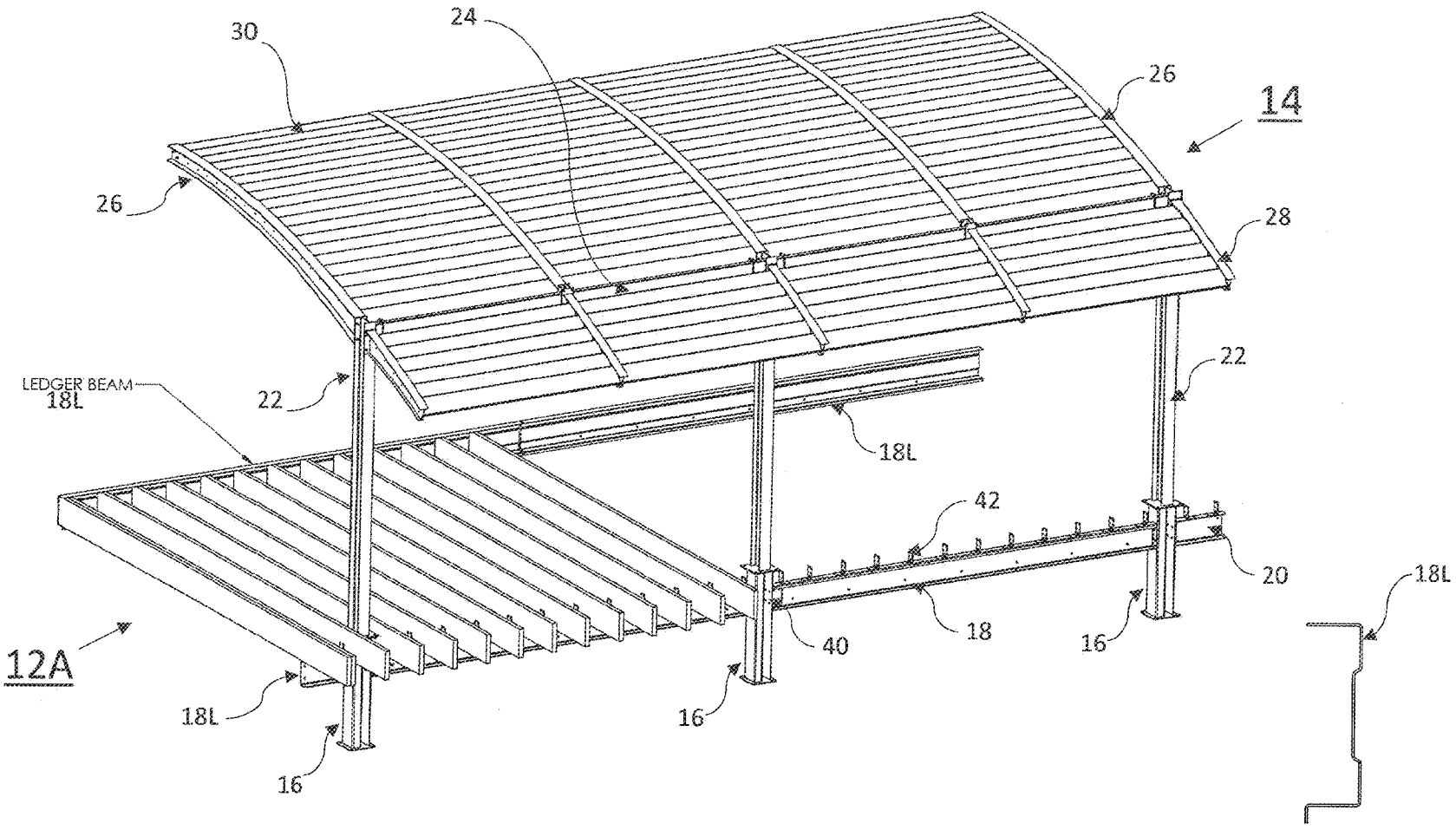
FIG. 7 is an isometric view of an alternative embodiment of the present invention, using metal ledger board to attach the deck framing system to an existing structure.

As mentioned above, the modular framing system of the present invention may be formed as either a completely free-standing structure, as shown in FIG. 1, or formed to attached to a structure upon completion. FIG. 7 illustrates a deck framing system 10A that is particularly configured to attach to an existing structure. In comparing the elements of FIG. 1 to FIG. 7, the only difference is the lack of posts 16 across the front edge F of base framing system 12A. Instead, metal beams 18 along front edge F function as a modular "ledger board" which is thereafter attached to a structure (house) using conventional brackets and fasteners. A cross-section of an exemplary type of metal beam 18 is also shown in FIG. 7, where the C-channel configuration is useful in supporting the joists, as well as providing a strong, interlocking support structure should a multiple number of such beams need to be joined together to provide a decking system of a desired length.

Figure 8:
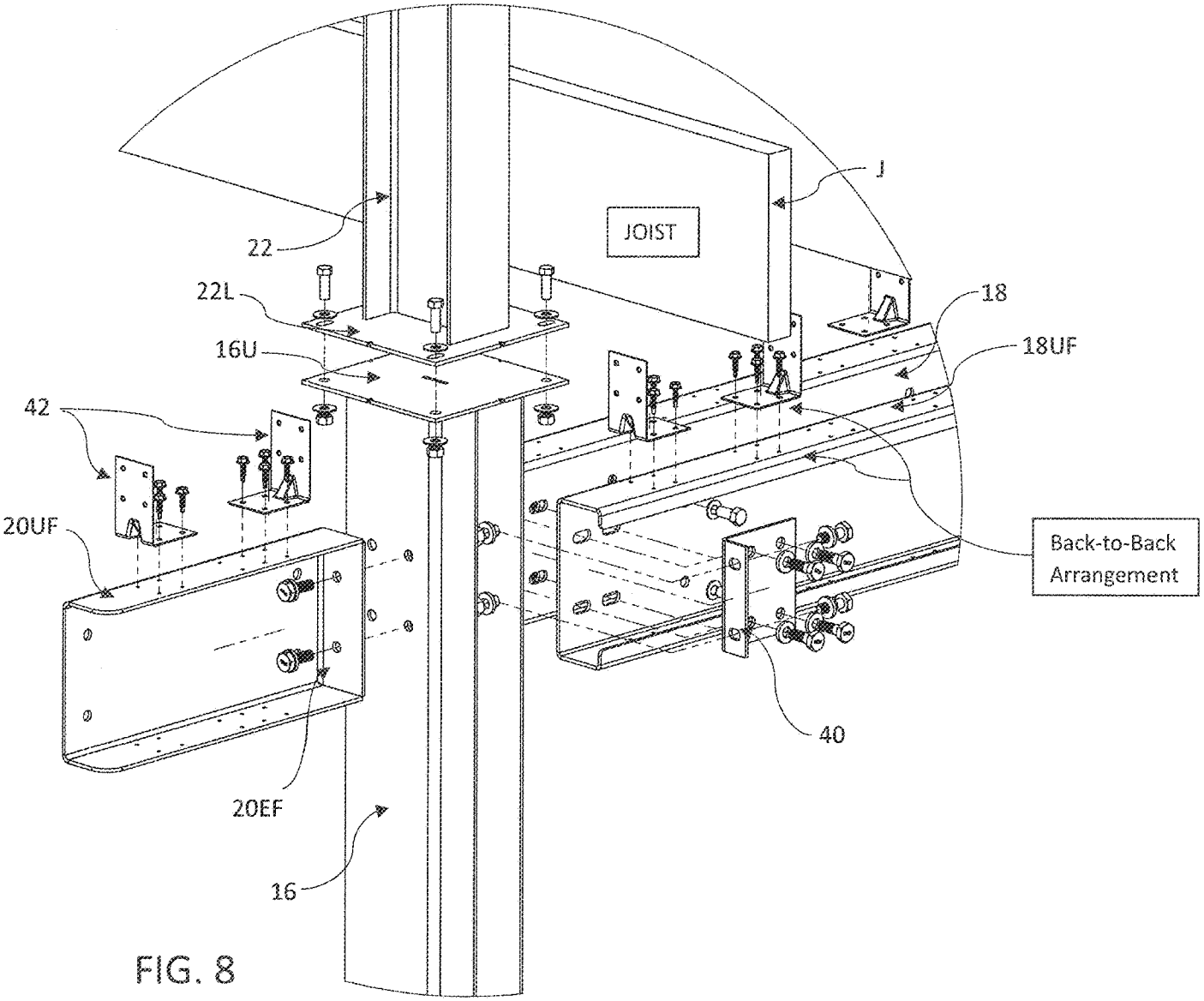
FIG. 8 is a close-up, isometric view of a fastener structure that may be used to join together the components forming the free-standing framing structure of the present invention.

FIG. 8 is an enlarged view of an exemplary type of fastener structure that may be used to join together the components forming the inventive modular framing structures. In particular, FIG. 8 illustrates the joining areas of support post 16 and pergola vertical post 22. In this arrangement support post 16 is shown as having an extended size upper portion (plate) 16U that is sized to mate with an extended size lower portion (plate) 22L of vertical post 22. Appropriate types of bolts, screws, etc. may then be used to join plate 16U to plate 22L and hold support post 16 and vertical post 22 in a fixed position.

Also shown are a portion of a beam 18, as well as a cantilever beam 20, both of which are attached to pre-defined locations along support post 16. An angle bracket 40 is shown as being located within the interior of the C-channel configuration of beam 18, with angle bracket 40 attaching to both support post 16 and beam 18. Cantilever beam 20 may be similarly attached. Alternatively, as shown in FIG. 8, cantilever beam 20 may have a closed end face 20EF that is directly attached to support post 16. Also shown in FIG. 8 are a plurality of L-brackets 42 that are attached to upper flange surface 18UF of beam 18 (as well as upper flange surface 20UF of cantilever beam 20). Although not as visible, L-brackets 42 are also shown in FIGS. 1 and 7. These brackets are used to attach joists J to the inventive framing structure, where in some cases it is contemplated that the beams may be manufactured to include the L-brackets (spaced apart as required to hold the joists in a manner that meets building code requirements).

Figures 9A, 9B, 10:
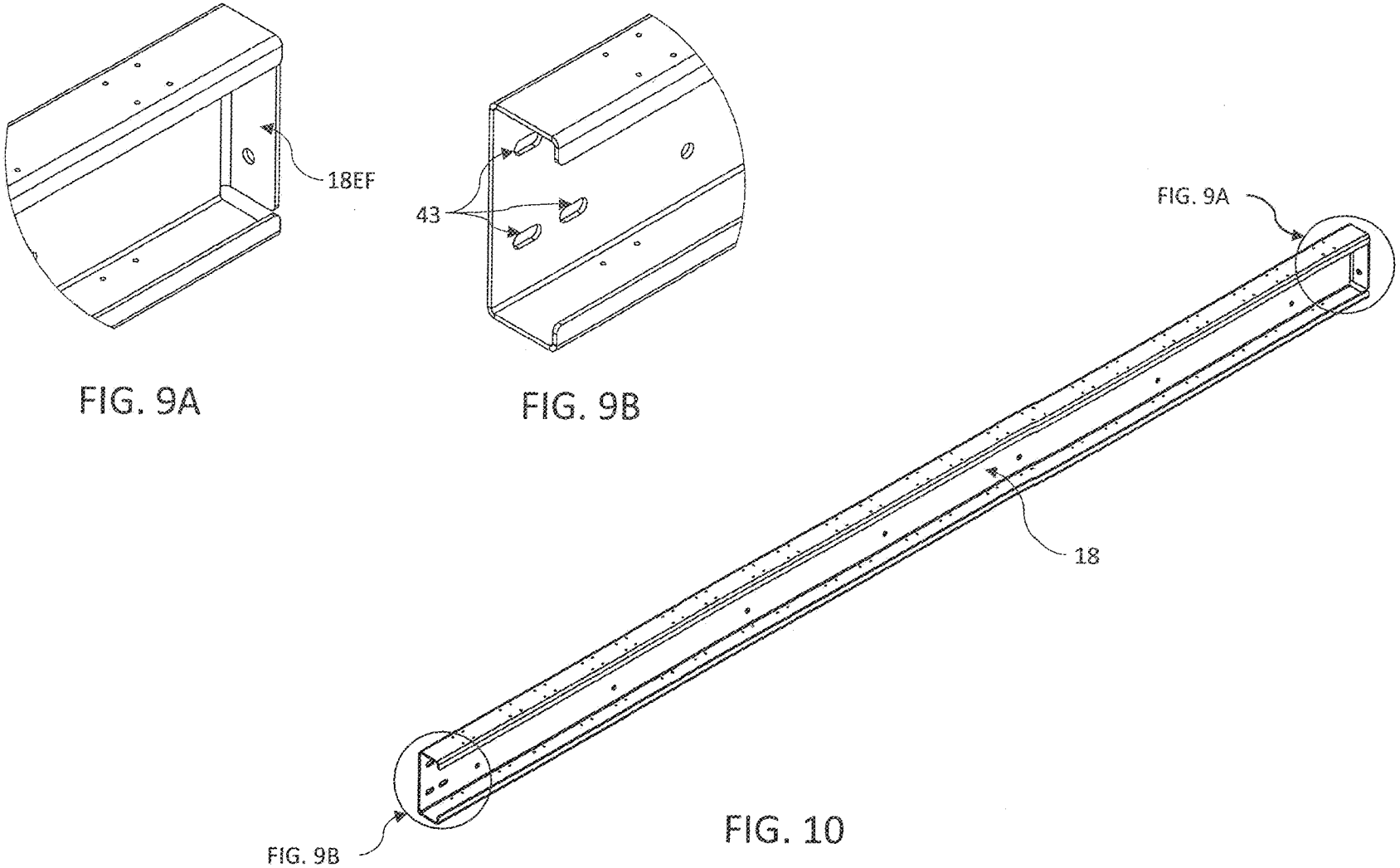
FIGS. 9A and 9B illustrate detailed arrangements of end terminations of a C-channel support beam, the view of FIG. 9A showing a closed end face and the view of FIG. 9B showing a set of cut-out slots that provide for adjustments in attachment positions with respect to the support posts.
FIG. 10 is an isometric view of a support beam, showing both end terminations of FIGS. 9A and 9B.

FIGS. 9 and 10 illustrate even greater detail of an exemplary configuration of C-channel beam 18. In particular, FIG. 9A illustrates a portion of a C-channel beam 18 that includes a closed end face 18EF, similar to form to closed end face 20EF of cantilever beam 20. The closed end feature allows for C-channel beam 18 to be directed connected to a proper location of a support post 16 without the need for additional brackets and/or other attachment components. Another important feature of these C-channel beams 18 is particularly illustrated in FIG. 9B, which is a opposing termination of a typical C-channel beam 18. Here, a plurality of cut-out slots 43 are shown as positioned at different positions with respect to the edge termination (one slot 43 being hidden in this view). The use of multiple cut-out locations provides flexibility in attachment; that is allowing for an adjustment in attachment location should a mating support post 16 be slightly off-centered from its intended position. FIG. 10 shows in an isometric view of an exemplary C-channel beam 18 having the two different end terminations as shown in FIGS. 9A and 9B.

Figure 12:
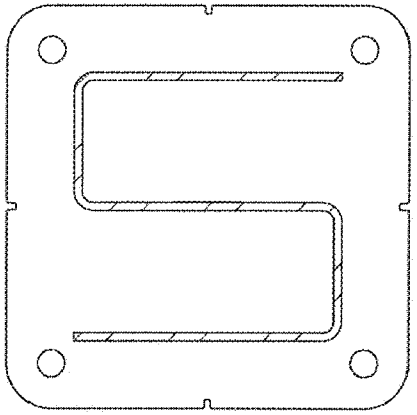
FIG. 12 is a cut-away view of the support post of FIG. 11, taken along line H-H, illustrating the S-shaped structure of the support post, utilized to increase the stability of the decking system.
Figure 11:
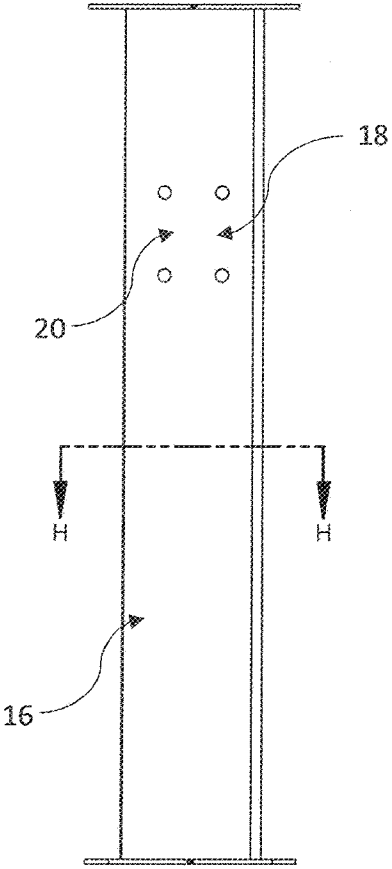
FIG. 11 is a side view of an exemplary support post of a particular geometry.

FIGS. 11 and 12 illustrate a particular physical geometry for a support post 16. FIG. 11 is a side view of support post 16, including an indication where a C-channel beam 18 or a cantilever beam 20 may be attached thereto. Rather than having a typical I-beam structure, however, this particular configuration has a more squared-off S-shaped structure, as shown in FIG. 12. In particular, FIG. 12 is a cut-away view of support post 16, taken along line H-H of FIG. 11 (i.e., looking downward into support post 16). This particular geometry is considered to provide additional stability in cases where the decking system is subjected to high winds and other extreme forces.

While the present invention has been described with reference to various embodiments, it will be understood that these embodiments are illustrative only, and that the scope of the present invention is not limited to their specific forms. Many variations, modifications, re-configurations, and the like are possible and are considered to fall within the scope of the present invention as defined by the claims appended hereto.

What is claimed is:

1. A free-standing modular decking system for use with an existing structure, the free-standing decking system comprising:

a plurality of sheet metal support posts, each individual sheet metal support post of the plurality of sheet metal support posts comprising a squared-off S-shaped structure for providing stability to the free-standing modular decking system, the plurality of sheet metal support posts disposed in a pattern considered to support a designed floor load, including at least a front set of spaced-apart support posts and a rear set of spaced-apart support posts in alignment with the front set, the plurality of sheet metal support posts for being permanently affixed to ground locations, wherein the number of individual sheet metal support posts and locations thereof support a modular design of any desired arrangement with the possibility of including further attachments thereto at a later point in time; and a plurality of sheet metal support beams including a first set of sheet metal support beams attached between adjacent ones of the front set of spaced-apart support posts and a second set of sheet metal support beams attached between adjacent ones of the rear set of spaced-apart support posts, the plurality of sheet metal support beams attached to pre-defined locations along sides of the squared-off S-shaped structure, where the number and location of the sheet metal support beams may also be reconfigured over time to support the modular design of the free-standing decking system.

2. The free-standing modular decking system as defined in claim 1 wherein the plurality of sheet metal support beams comprises at least C-channel sheet metal support beams, the free-standing modular decking system further comprising a plurality of bracket-based attachment members to provide attachment between the plurality of sheet metal support posts and the pre-defined locations along sides of the plurality of sheet metal support beams.

3. The free-standing modular decking system as defined in claim 2 wherein the C-channel sheet metal beams further comprise a set of spaced-apart L-brackets disposed along a top surface thereof, the L-brackets sized and positioned for attachment of floor joists thereto.

4. The free-standing modular decking system as defined in claim 2 wherein the plurality of sheet metal support beams comprises paired C-channel sheet metal beams, disposed in a back-to-back configuration to create I-beam arrangements for additional strength.

5. The free-standing modular decking system as defined in claim 1 wherein at least one sheet metal support beam is formed to include a closed end surface at one termination thereof for attachment at the pre-defined locations along a side of an adjacent sheet metal support post.

6. The free-standing modular decking system as defined in claim 5 wherein the at least one sheet metal support beam is further formed to include a set of cut-out slots in proximity to the positioning of the sheet metal support beam with respect to the adjacent sheet metal support post, providing additional attachment locations as needed for adjustments to specific locations of the sheet metal support posts.

7. The free-standing modular decking system as defined in claim 1, further comprising a plurality of cantilever sheet metal beams attached to selected ones of the sheet metal support posts located at defined end positions of the decking system, the cantilever sheet metal beams disposed in line vertically with the sheet metal support beams.

8. The free-standing modular decking system as defined in claim 7 wherein one or more of the cantilever sheet metal beams includes a closed end surface for attachment to the associated support post.

9. The free-standing modular decking system as defined in claim 1, further comprising a sheet metal covering structure including a first plurality of sheet metal vertical posts having opposing lower and upper end terminations, the lower end terminations attached to selected ones of the sheet metal support posts from the plurality of sheet metal support posts;

a set of horizontal sheet metal support beams connected between upper end terminations of the first plurality of sheet metal vertical posts;

a plurality of long curved sheet metal beams extending forward from and attached only to the upper end terminations of the first plurality of sheet metal vertical posts; and a plurality of slats connected between the plurality of long curved sheet metal beams, the plurality of slats angled so as to provide a shading effect in the presence of sunlight.

10. The free-standing modular decking system as defined in claim 9 wherein the plurality of slats are fixedly connected between the plurality of long curved sheet metal beams.

11. The free-standing modular decking system as defined in claim 9 wherein at least a set of slats of the plurality of slats are attached in a movable manner to the plurality of long curved sheet metal beams.

12. The free-standing modular decking system as defined in claim 9, wherein additional long curved sheet metal beams are attached to, and extend forward from, spaced-apart locations along the horizontal sheet metal support beams.

13. The free-standing modular decking system as defined in claim 9 wherein the sheet metal covering structure further comprises a second plurality of sheet metal vertical posts attached to selected ones of the sheet metal support posts; and a second plurality of long curved sheet metal beams coupled to free ends of the first plurality of long curved sheet metal beams in a manner to form an arc-shaped covering, the opposing end terminations of the second plurality of long curved sheet metal beams coupled to upper end terminations of the second plurality of sheet metal vertical posts.

* * * * *